US005538344A

United States Patent [19]

Dybdahl

[11] Patent Number: 5,538,344

[45] Date of Patent: Jul. 23, 1996

[54] DEVICE FOR THE POSITIONING OF A MIXING BODY WITH RESPECT TO A FLUID FLOW AREA

[75] Inventor: Bjørn Dybdahl, Haugesund, Norway

[73] Assignee: Petrotech AS, Haugesund, Norway

[21] Appl. No.: 240,681

[22] PCT Filed: Aug. 27, 1992

[86] PCT No.: PCT/NO92/00135

§ 371 Date: Apr. 19, 1994

§ 102(c) Date: Apr. 19, 1994

[87] PCT Pub. No.: WO93/08369

PCT Pub. Date: Apr. 29, 1993

[30] Foreign Application Priority Data

Oct. 24, 1991 [NO] Norway ..... 914174

[51] Int. Cl.[6] ..... F15D 1/02; B01F 5/06

[52] U.S. Cl. ..... 366/340; 138/44; 138/45; 366/336

[58] Field of Search ..... 73/204.21, 861.32, 73/861.61, 861.62; 138/44, 45; 366/336, 337, 338, 340

[56] References Cited

U.S. PATENT DOCUMENTS

| | | | |
|---|---|---|---|
| 1,559,547 | 11/1925 | Brown | 73/861.61 |
| 1,921,298 | 8/1933 | Lewis | 138/45 |
| 3,079,796 | 3/1963 | Freudenthal | 138/45 |
| 3,780,982 | 12/1973 | Kemp | 138/44 |
| 4,352,572 | 10/1982 | Chen | 366/340 |
| 4,352,573 | 10/1982 | Pandolfe | 366/340 |
| 4,410,010 | 10/1983 | Van Scoy | 138/44 |
| 4,514,095 | 4/1985 | Ehfeld | 366/340 |
| 4,781,536 | 11/1988 | Hicks | 73/861.61 |

FOREIGN PATENT DOCUMENTS

| | | | |
|---|---|---|---|
| 6-123648 | 5/1994 | Japan | 73/861.61 |
| 210400 | 4/1968 | U.S.S.R. | 73/861.32 |
| 1476147 | 6/1977 | United Kingdom | 73/861.61 |

*Primary Examiner*—David Scherbel
*Assistant Examiner*—Terrence R. Till
*Attorney, Agent, or Firm*—Fulbright & Jaworski

[57] ABSTRACT

The invention relates to a device (2) designed and adapted to bring an in per se known mixing body (11) to correspond to a fluid flow area which e.g. is defined by a pipeline (1,3) wherein a two-phase fluid may flow, said fluid being desired to be mixed in connection with sampling (4), and to withdraw the mixing body (11) easily and rapidly in order to release said fluid flow area. For this purpose, the device according to the invention comprises a valve housing (6) formed for fluid-tight connection to said pipeline in an area of two diametrally opposite openings (1', 1") of the pipeline, enclosing said openings. Within the valve housing (6), a sluice body (5) carrying said mixing body (11) has been displaceably arranged. The sluice body (5) and thus the mixing body (11) is displaceable between two main positions. In one main position, the mixing body (11) has been brought to correspond with said fluid flow area. In the other main position, the mixing (11), through the sluice body (5), has been drawn into the valve housing (6) to a position wherein the fluid flow area has been uncovered. In the lastmentioned main position, a through-going bore (10) of the sluice body (5) can be brought to correspond with the fluid flow area, said through-going bore (10) having a diameter substantially corresponding to the diameter of the flow area of the pipeline (1,3), downstreams the sluice body (5).

7 Claims, 1 Drawing Sheet

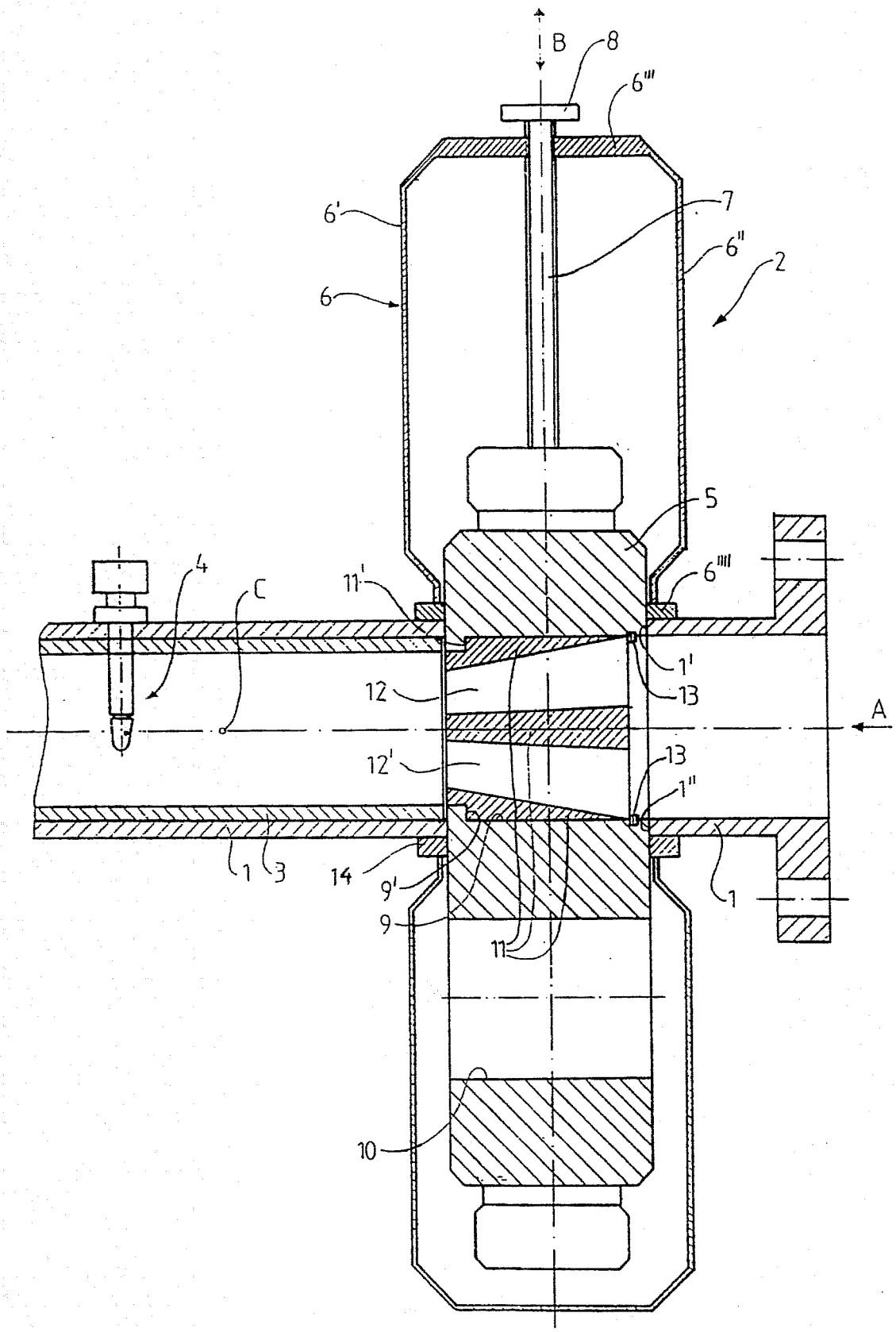
B
8
6'''
6'
7
6''
2
6
5
4
C
11'
6''''
1'
13
12
A
12'
13
1''
1
3
14
9'
9
1
11
10

DEVICE FOR THE POSITIONING OF A MIXING BODY WITH RESPECT TO A FLUID FLOW AREA

This invention relates to a device for the positioning of a mixing body with respect to a fluid flow area, for the mixing of a fluid, for example in a two-phase or multi-phase stream, especially but not exclusively in connection with sampling.

NO patent application No. 912796 discloses an isokinetic sampling apparatus adapted to take isokinetic fluid samples during different production conditions and which is connectable to a sampling point within a pipe, a tank, a separator, a heat exchanger, etc., wherein the fluid flows and is under a substantial pressure.

The present invention may be utilized in association with a sampling apparatus of this or similar kind, and has at least as large a field of use as the sampling apparatus according to NO patent application No. 912796 but, as the present invention is concerned with the positioning of a mixing body e.g. adapted with a view of mixing the gas component and the liquid component of a two-phase flow in a way to be closer described in the following, and as said mixing body positioning does not have any direct connection with said sampling but exclusively with the mixing effect caused, other applications of the present invention may be wherein the mixing function and the withdrawl of the body do not have any real association with an actual sampling.

For such a two- or multi-phase flow mixing and sampling, it is previously known very bulky sampling manifolds comprising three valves each weighing 500 kg, carried by a framework having a weight of 1500 kg. In one embodiment, this prior art sampling manifold consists of a pipe system having an upper inlet for the two- or multi-phase fluid to be tested, said upper inlet being connected to a first horizontal pipe piece wherein a first wheel-operated valve is coupled and which passes into a vertical pipe piece wherein the mixing body is fixedly mounted upstream of a sampling point. From there extends a horizontal pipe piece having an incorporated valve to the outlet, which is connected to the inlet via a pipe portion having an incorporated third valve. This prior art sampling manifold is too bulky, heavy and expensive in order to constitute an easily portable sampling apparatus having a reasonably wide application area. The inlet of the apparatus has to be coupled to the tested pipeline axially, and in many cases this is equivalent to the fact that the fluid flow within the tested pipeline or the like must be brought to cease prior to the connection and disconnection of the sampling manifold, if this very expensive known apparatus is not be connected permanently, the fluid flow then intermittently (each time a sampling is to take place) being guided through the apparatus.

From GB patent application No. 2,041,035, methods and apparatus for sampling have been known. The samples are taken from a fluid flow passing out from a well or the like, wherein the fluid comprises gas- and liquid-phase components. The pipeline wherewithin the two-phase flow passes and wherein the sampling is to be effected, is, according to this British patent application, equipped with a conventional mixing body which has been displaced axially into the pipeline, with all the difficulties such a positioning would involve especially with a view to the general withdrawal possibilities for the mixing body and its potenial need for maintenance and exchange.

A mixing body of the kind concerned consists conventionally of a relatively short pipe-shaped metal body having axial through-going bores which, except from a possible central bore, extend slopingly in relation to the longitudinal axis of the pipe-shaped mixing body, so that all bores meet in an imaginary "focal point". Such a mixing body wherein its axial slopingly extending bores effect an efficient mixing of the two phases of the flowing medium, particularly in the area of said "focus", has to be placed upstreams a sampling probe, the inlet end thereof thereby being located at a desired distance from said "focus".

Therefore, according to the present invention, one has aimed at providing a device for the positioning of a mixing body with respect to a flow area defined by a pipeline or a pipe or a hollow body, respectively, having a through-going bore incorporated into a tank, a separator, a heat exchanger, etc., conducting a flowing fluid, e.g. in the form of a two-phase flow, said device is to be simple in construction, easy to operate and exhibiting a minimum extent, and with which a mixing body of the kind concerned easily may be brought into operative position within said flow area as well as being withdrawn from operative position to a withdrawn, inactive position of readiness, wherein the mixing body possibly may be subjected to maintenance or exchange.

In accordance with the invention, said objects are realized through designing and adapting a device according to the preamble of the following claim 1, in accordance with the features as set forth in the characterizing part of claim 1.

Advantageous, yet subordinate features of the invention as defined in claim 1, are indicated in the dependent claims.

The device according to the invention comprises an externally closed sluice valve housing having attachment means for fluid-tight connection to a diametrally perforated circumferential portion of a pipeline or similar pipe member, which internally defines a flow area and through which flows a fluid,e.g. a fluid containing gas as well as liquid, said sluice valve housing enclosing a sluice body having at least one gate for the accommodation of a mixing body and which, preferably, additionally is formed with a blind gate having dimensions corresponding to said flow area, said sluice body being displaceably supported within the valve housing in directions perpendicular to the axis of said gate(s), i.e. normally laterally of the longitudinal axis of said pipeline/pipe member.

By means of such a sluice device which through a simple flange connection may be coupled fluid-tight to said diametrally perforated circumferential portion, the mixing body may be brought rapidly and easily into an operative position wherein it covers said fluid area so that the flowing fluid is urged to follow the slopingly extending paths defined by the through-going bores of the mixing body, whereby the intentional mixing function is initiated; the mixing body may as rapidly and easily be brought back to an inactive position wherein, possibly, maintenance or exchange may be performed. Thereby, the entire sluice body may be pulled out of the flow area, yet one achieves a more balanced arrangement by using said preferred embodiment where the sluice body, in addition to the gate for the mixing body, has a further gate, a kind of blind gate which, upon pulled-out mixing body is brought to correspond to the flow area. The gates of the sluice body may thereby e.g. be dimensioned such that their intermediate portion never can close the flow area more than one third of full opening.

Normally, the blind gate will have the same diameter as the flow area in that pipeline or pipe member to which the connecting means for the device or the sluice valve housing respectively, may have an annular flange coupling, wherein the ring flanges surround radially directed, diametrally opposing openings in said pipeline or pipe member, respectively. Thereby, the valve housing may have a closed annular shape, but may, in a fundamentally possible embodiment, have a more diametrally extending cylinder shape.

An examplary embodiment is further explained in the following, reference being made to the accompanying drawing figure which in an axial section shows a device for positioning a mixing body with respect to a flow area defined by a pipeline wherein a fluid is flowing with isokinetic speed, and into which pipeline, downstreams the mixing body, is mounted an in per se known sampling probe, the latter not constituting any part of the present invention.

Reference is made to the figure of the drawing, wherein the reference numeral 1 denotes said pipeline through which a fluid is flowing, the direction of flow being indicated at A.

Generally, the reference numeral 2 denotes the device according to the invention, and an internal bushing 3 determines the flow area downstreams the device 2. A sampling probe 4 is likewise placed downstreams the device 2 and is intended to take respective fluid samples in an area in which the fluid is in mixed condition, the mixing being effected by means of an in per se known mixing body incorporated into the device according to the invention, said mixing body as such not constituting any actual part of the invention.

The fluid-conducting pipeline 1 is, at two diametrally opposite locations, formed with through-going circular openings 1' and 1". These circle openings 1', 1" are formed with a view to allowing passage of a sluice body 5 incorporated into the device 2 according to the invention.

Moreover, the device according to the invention comprises a sluice valve housing 6 having mutually spaced, parallel gable walls 6' and 6" as well as an annular circumferential portion 6'" connecting the former with each other. However, the valve housing 6 may be formed with a circumferential portion 6'" not extending around the entire periphery of the pipeline 1, provided that the housing 6 covers and encloses the circle openings 1', 1" of the pipeline 1. Then, radially extending housing walls (not shown) have to be arranged, extending substantially laterally of the gable walls 6', 6".

The sluice body 5 which in the embodiment shown may have the shape of a relatively thick rectangular plate or disc, is displaceably supported within the housing 6 in directions B parallel to the gable walls 6', 6", i.e. perpendicular to the flowing direction A of the fluid within the pipeline 1. The sluice body 5 carries a valve spindle 7 having an external activation means 8, with which the sluice body 5 may be displaced in said opposite directions B.

The sluice body 5 has two laterally spaced, parallel gates 9 and 10, the axis thereof extending substantially parallel to the longitudinal axis of the pipeline 1, said axis coinciding with the flowing direction A of the fluid.

One 10 of said gates 9,10 is a kind of blind gate having the same diameter as the internal diameter of the pipeline 1,3, downstreams the device 2.

The other gate 9 is formed for the accommodation of an in per se known throttle/mixing body 11 formed with axial, through-going bores 12,12', the central lines thereof forming acute angles in relation to the axis of the throttle/mixing body 11 and of the pipeline 1, respectively. Thus, the axis continuations of the inclined bores 12,12' meet in known manner in a "focal point" or "focus" C wherein the mixing effect is maximum. This "focal point" C—the mixing concentration point—is, as known, to be located somewhat upstreams the sampling probe 4, which represents wellknown technology.

The throttle/mixing body-accommodating gate 9 is formed with an annular shoulder 9' against which a corresponding shoulder 11' comes to rest upon the insertion of the body 11 into the gate 9, easily releasable attachment/locking means 13 being arranged at the end of the gate opposite the shoulder 9'. Thus, with rapid and simple handgrabs, the throttle/mixing body 11 should be brought in place within the sluice body 5 in the position shown in the figure of the drawing as well as out of the gate 9 of the sluice body 5 for inspection, maintenance and, possibly, replacement.

When there is no need for any throttling/mixing of the flow of fluid through the pipeline 1,3 e.g. because the sampling has been completed, the sluice body 5 is displaced upwards according to the figure, via the spindle 7 and the actuation means 8, until the blind gate 10 which has the same diameter as the pipe 3, is brought to correspond therewith.

Centrally, the valve housing 6 has somewhat tapering wall portions functioning as guide walls for the sluice body 5 during the displacement movements thereof, said wall portions carrying ring flanges 6'" for fluid-tight connection to the pipeline 1. For the sake of clarity, seals have been omitted from the figure.

What is claimed is:

1. A device for the positioning of a mixing body in a pipe comprising:

a sluice valve housing;

means for sealingly connecting the sluice valve housing to a pipe;

a sluice valve body displaceably positioned within the sluice valve housing, the sluice valve body defining first and second parallel conduits alternatively communicable with the pipe; and a mixing body disposed within the first conduit wherein the mixing body has non-parallel channels therethrough.

2. The apparatus of claim 1 further comprising means for locking the sluice valve body within the first conduit.

3. A device for the positioning of a mixing body adapted to throttle and, thus, mix a two-phase fluid flowing in a pipe, in order intermittently to provide thoroughly mixed fluid suitable for sampling, comprising:

an elongated sluice valve housing;

means for sealingly connecting the elongated sluice valve housing permanently to the pipe, a sluice valve body displaceably positioned within the sluice valve housing, the sluice valve body having first and second spaced, through-going, mutually parallel bores parallel to the longitudinal axis of the pipe;

means for displacing the sluice valve body in the longitudinal direction of the elongated sluice valve housing in order to make the through-going bores alternatively communicable with the pipe; and a mixing body accommodated within the first through-going bore, the mixing body containing non-parallel through-going channels each extending substantially in the longitudinal direction of the pipe.

4. The apparatus of claim 3, in which the second through-going bore has a diameter substantially corresponding to the internal diameter of the pipe.

5. The apparatus of claim 3, further comprising means for locking the mixing body within the first through-going bore.

6. The apparatus of claim 3, in which the elongated sluice valve housing includes two spaced mutually parallel walls extending perpendicularly to the pipe, the means for sealingly connecting the sluice valve housing to the pipe comprising first and second ring flanges.

7. The apparatus of claim 3, in which a longitudinal axis of the non-parallel through-going channels of the mixing body are orientated such as to intersect each other substantially in a common imaginary point positioned on the axis of the mixing body, downstream thereof, the axis sloping gradually in a radially inwardly extending direction from an upstream to a downstream position.

* * * * *